US007808190B2

(12) United States Patent
Park

(10) Patent No.: US 7,808,190 B2
(45) Date of Patent: Oct. 5, 2010

(54) DISPLAY APPARATUS AND POWER SUPPLYING APPARATUS FOR LAMP UNIT THEREOF

(75) Inventor: Cheol-Jin Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 170 days.

(21) Appl. No.: 11/432,431

(22) Filed: May 12, 2006

(65) Prior Publication Data

US 2006/0273739 A1 Dec. 7, 2006

(30) Foreign Application Priority Data

Jun. 7, 2005 (KR) ..... 10-2005-0048608

(51) Int. Cl.
*H05B 37/02* (2006.01)

(52) U.S. Cl. ..... 315/291; 315/307; 315/224

(58) Field of Classification Search ..... 315/291, 315/224

See application file for complete search history.

(56) References Cited

U.S. PATENT DOCUMENTS 3,816,687 A * 6/1974 Heitner ..... 219/630
6,057,633 A * 5/2000 Inoi et al. ..... 310/345
6,144,360 A 11/2000 Evanicky et al.
2004/0004450 A1* 1/2004 Hsu et al. ..... 315/291
2004/0051692 A1 3/2004 Hirakata et al.
2004/0232853 A1 11/2004 Hur et al.
2004/0240235 A1 12/2004 Min
2005/0253537 A1* 11/2005 Jang et al. ..... 315/307
2006/0076907 A1* 4/2006 Chen et al. ..... 315/312

FOREIGN PATENT DOCUMENTS

CN 1575084 A 2/2005
JP 06-289363 10/1994
JP 2000-047169 2/2000
JP 2000-047208 2/2000
KR 10-2000-0058057 9/2000
KR 2003057684 A * 7/2003
KR 10-2003-0081728 10/2003
KR 10-2003-0083177 10/2003
KR 10-2005-0045625 5/2005

* cited by examiner

*Primary Examiner*—Douglas W Owens
*Assistant Examiner*—Jae K Kim
(74) *Attorney, Agent, or Firm*—Roylance, Abrams, Berdo & Goodman, L.L.P.

(57) ABSTRACT

A display apparatus is provided with a panel to display a picture thereon. The display apparatus comprises an inverter to convert DC power into AC power. The display apparatus also includes at least one lamp unit comprising a lamp body and a lamp electrode part provided in at least one of opposite ends of the lamp body to receive an electric power. A transformer is arranged adjacent to the lamp electrode part to boost up a voltage of the electric power output from the inverter to supply the electric power with the boosted voltage as a driving power to the lamp unit.

12 Claims, 5 Drawing Sheets

DISPLAY APPARATUS AND POWER SUPPLYING APPARATUS FOR LAMP UNIT THEREOF

CROSS-REFERENCE TO RELATED APPLICATIONS

This application claims the benefit under 35 U.S.C. §119 (a) of Korean Patent Application No. 2005-0048608, filed Jun. 7, 2005, in the Korean Intellectual Property Office, the entire disclosure of which is hereby incorporated by reference.

BACKGROUND OF THE INVENTION

1. Field of the Invention

The present invention relates to a display apparatus. More particularly, the present invention relates to a display apparatus having an improved structure for applying a high voltage to a lamp unit.

2. Description of the Related Art

Generally, a display apparatus receives a video signal of a predetermined display mode from a video signal source such as a computer or a television broadcasting system. The video signal is then displayed as a picture. Display apparatuses have gradually developed from a cathode ray tube (CRT). Currently there is a growing trend toward flat panel displays. Flat panel displays generally use a liquid crystal display (LCD) panel or a plasma display panel (PDP).

In particular, a general display apparatus employing the LCD panel is lightweight, thin, and consumes less power. Therefore, the LCD panel has been widely used in capacities such as office automation equipment and audio/video devices. The display apparatus employing the LCD panel cannot emit light by itself. A separate light source, such as a backlight unit, is required. Thus, the LCD panel displays a picture using light emitted from the backlight unit. Examples of light sources for backlight units are a cold cathode fluorescent lamp (CCFL), an extra electrode fluorescent lamp (EEFL), and a flat fluorescent lamp (FFL).

To supply high voltages to these lamp units, the conventional display apparatus employs a transformer in an inverter to boost up voltage and supplies the high voltage to the lamp unit through a long electric wire. However, in the conventional display apparatus, while the boosted high voltage is supplied through the long electric wire, current leakage may occur.

Accordingly, there is a need for an improved display apparatus which minimizes current leakage.

SUMMARY OF THE INVENTION

An aspect of the embodiments of the present invention is to address at least the above problems and/or disadvantages and to provide at least the advantages described below. Accordingly, an aspect of the embodiments of the present invention is to provide a display apparatus in which a high voltage generating position for a lamp unit changes to reduce the length of an electric wire through which a high voltage is supplied, thereby minimizes current leakage.

The foregoing and/or other aspects of embodiments of the present invention are achieved by providing a display apparatus with a panel to display a picture thereon. The display apparatus comprises an inverter to convert DC power into AC power. At least one lamp unit comprises a lamp body and a lamp electrode part provided in at least one of opposite ends of the lamp body to receive an electric power. A transformer is arranged adjacent to the lamp electrode part to boost up voltage of the electric power output from the inverter to supply the electric power with the boosted voltage as a driving power to the lamp unit.

According to another aspect of embodiments of the present invention, the display apparatus may further comprise a casing to accommodate the lamp unit in a position opposite to the panel, wherein the transformer is arranged corresponding to the lamp electrode part. Therefore, the casing is arranged between the transformer and the lamp unit.

According to another aspect of embodiments of the present invention, the display apparatus may further comprise a balance unit to adjust a current of the electric power applied to each lamp unit, wherein the inverter is provided in the balance unit.

According to another aspect of embodiments of the present invention, the transformer may comprise a first transformer and a second transformer. The first transformer is connected to the second transformer in parallel to boost up the voltage output from the inverter and to supply a current, which has a phase difference of 180 degrees from the current of the electric power supplied from the second transformer to the lamp unit.

According to another aspect of embodiments of the present invention, the inverter may comprise a first inverter to supply the AC power to the first transformer and a second inverter to supply the AC power to the second transformer.

According to another aspect of embodiments of the present invention, the display apparatus may further comprise a power supply comprising the inverter.

According to yet another aspect of embodiments of the present invention, the lamp may comprise at least one of a CCFL, an EEFL and an FFL.

The foregoing and/or other aspects of embodiments of the present invention are achieved by providing a power supplying apparatus for at least one lamp unit comprising a lamp body, a lamp electrode part provided in at least one of opposite ends of the lamp body to receive an electric power, the power supply comprising an inverter to convert DC power into AC power, and a transformer placed adjacent to the lamp electrode part which boosts up a voltage of the electric power output from the inverter to supply the electric power having the boosted voltage as a driving power to the lamp unit.

According to still yet another aspect of embodiments of the present invention, the power supplying apparatus may further comprise a power supply comprising the inverter.

Other aspects, advantages, and salient features of the exemplary embodiments of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
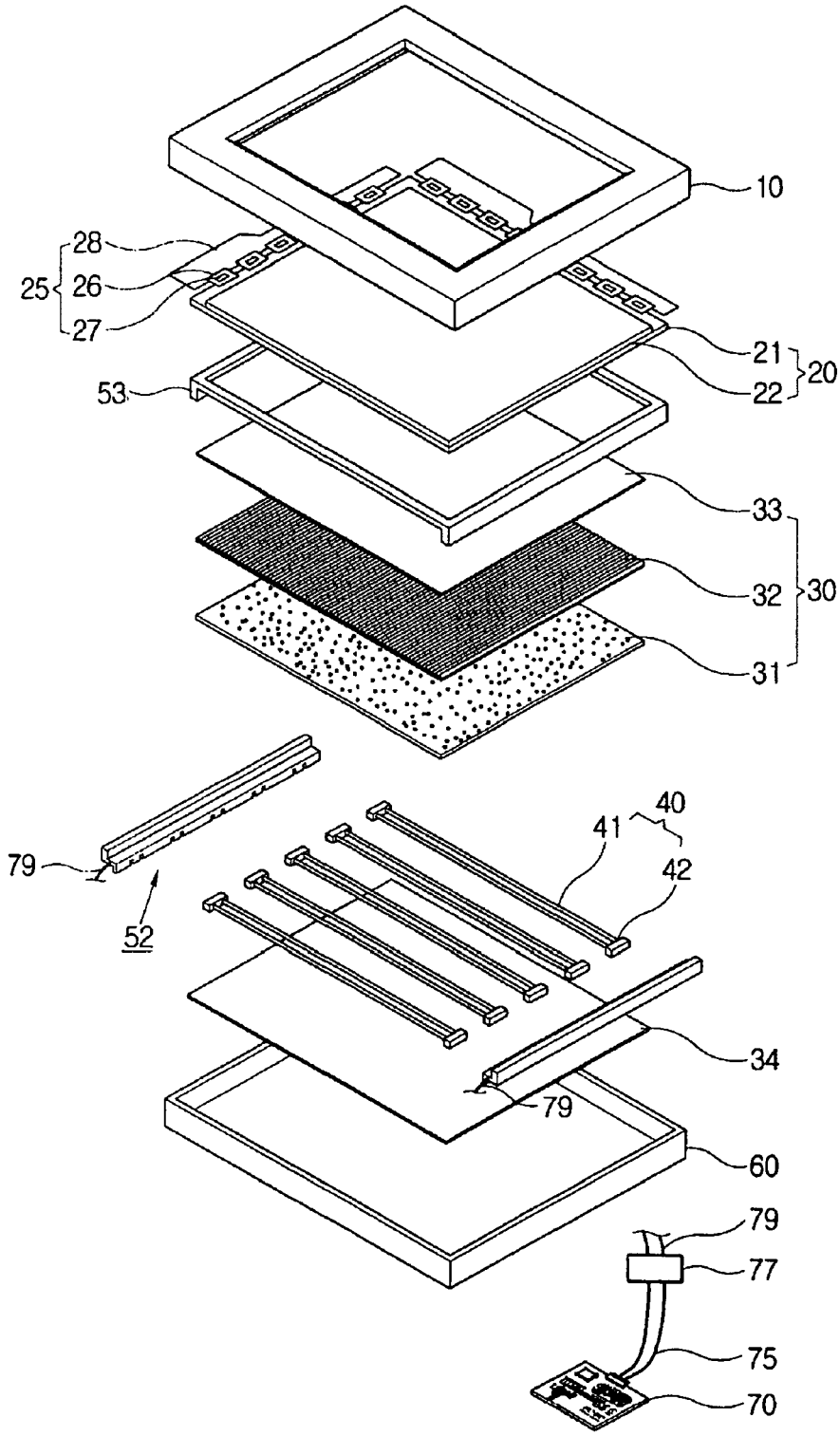
FIG. 1 is an exploded perspective view of a display apparatus according to an embodiment of the present invention.

As shown in FIG. 1, a display apparatus according to an embodiment of the present invention includes an LCD panel 20, a plurality of optical films 31, 32, 33 placed in the rear of the LCD panel 20, a lamp unit 40 provided throughout the rear of the LCD panel 20, a reflecting plate 34 placed in the rear of the lamp unit 40, and a lamp mold 52 which are accommodated between a front casing 10 and a rear casing 60.

The LCD panel 20 includes a thin film transistor (TFT) substrate 21 mounted with TFTs, a color filter substrate 22 opposite to the TFT substrate 21, a sealant (not shown) coupling two substrates 21 and 22 with each other forming a cell gap, and a liquid crystal layer (not shown) interposed between two substrates 21 and 22 and the sealant. The LCD panel 20 rearranges an orientation of molecular arrangement of the liquid crystal layer to display a picture, but cannot emit light by itself. Therefore, the LCD panel 20 should receive the light from the lamp unit 40 placed in the rear thereof. Meanwhile, a driving unit 25 is provided on one side of the TFT substrate 21 and applies a driving signal. The driving unit 25 includes a flexible printed circuit (FPC) 26, a driving chip 27 mounted on the FPC 26, and a printed circuit board (PCB) 28 connected to the FPC 26. In this embodiment, the driving unit 25 comprises a chip on film (COF), but is not limited thereto, and other suitable arrangements maybe used. Alternatively, a tape carrier package (TCP), a chip on glass (COG), and other well known types of driving units 25 can be used. Further, the driving unit 25 may be embedded on the TFT substrate 21.

The optical films 31, 32, 33 placed in the rear of the LCD panel 20 include a diffusion film 31 diffusing the light emitted from the lamp unit 40 toward the LCD panel 20. A prism film 32 focuses the light diffused by the diffusion film 31 in a direction perpendicular to a plane of the LCD panel 20 and a protection film 33 protects the prism film 32 that is relatively easily affected by scratches.

The lamp unit 40 includes a lamp body 41 to emit light and a lamp electrode part 42 provided in at least one of opposite ends of the lamp body 41 to receive an electric power. In this exemplary embodiment, the lamp unit 40 employs a CCFL and is provided as a direct type. Alternatively, the lamp unit 40 may employ lamp units 40 such as an EEFL or FFL. Further, the lamp unit 40 may be provided as an edge type instead of the direct type.

The lamp unit 40 is placed between the lamp molds 52 by an accommodating groove formed in the lamp mold 52. Here, the lamp mold 52 forms a pair at opposite sides of the LCD panel 20 and surrounds the opposite ends of the lamp unit 40. Further, the lamp mold 52 can support the optical films 31, 32, 33.

The reflection plate 34 is placed in the rear of the lamp unit 40 and reflects the light from the lamp unit 40 toward the diffusion film 31. Here, the reflection plate 34 can be made of polyethylene terephthalate (PET) or poly carbonate (PC).

The LCD panel 20, the optical film 30, the lamp unit 40, and the reflection plate 34 are accommodated between the front casing 10 and the rear casing 60.

Figure 2:
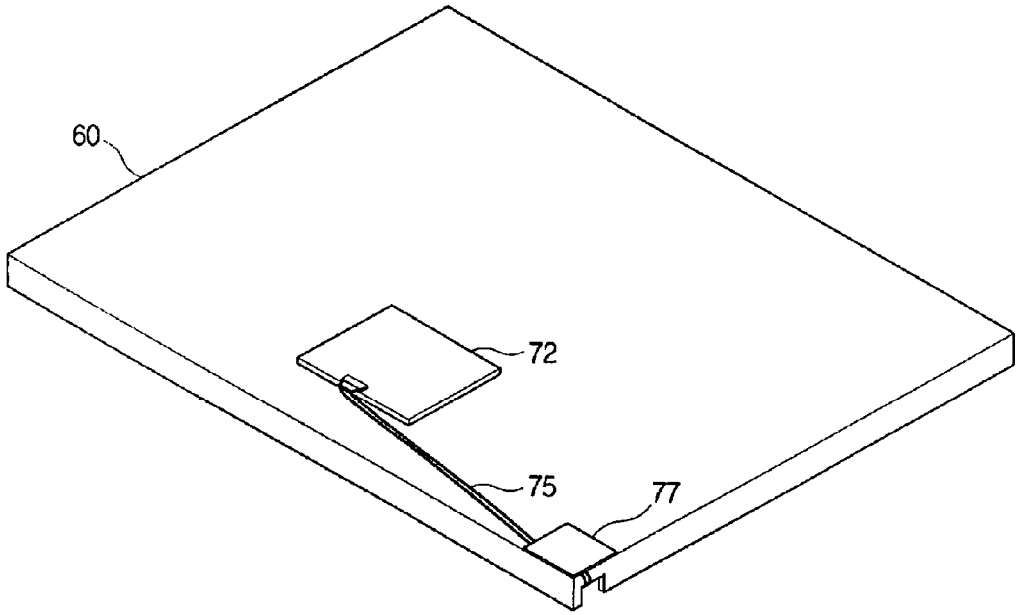
FIG. 2 is a rear perspective view of a back casing of a display apparatus according to a first embodiment of the present invention.

Meanwhile, as shown in FIG. 2, sn inverter 72 and a transformer 77 are provided in the back of the rear casing 60 so as to supply a driving power to the lamp unit 40.

The inverter 72 receives the electric power from an external or internal battery and supplies it to the transformer 77. The inverter 72 is placed on the back of the rear casing 60 corresponding to the lamp unit 40.

The inverter 72 converts DC power into AC power, and supplies the AC power to the external transformer 77 through an electric wire 75.

According to an embodiment of the present invention, the inverter 72 is internally provided in a power supply 70. In this embodiment, the power supply 70 is of a switching mode power supply (SMPS) that converts a low frequency AC power received from the exterior into high frequency DC power.

The transformer 77 is adjacent to the lamp electrode part 42 and boosts up a voltage of the electric power supplied from the inverter 72. Thus, the electric power is supplied as the driving power for the lamp unit 40 through the electric wire 79. For example, the transformer 77 receives the electric power having a voltage of 120V from the inverter 72 and the transformer 77 boosts up the voltage into a voltage of Here, the transformer 77 is adjacent to the lamp unit 40, so that the length of the electric wire 79 is very short.

According to a first embodiment of the present invention, as shown in FIG. 2, the transformer 77 is placed corresponding to one lamp electrode part 42, leaving the rear casing 60 between the transformer 77 and the lamp unit. Herein, the rear casing 60 accommodates the lamp unit 40 in a position opposite to the LCD panel 20.

Figure 3:
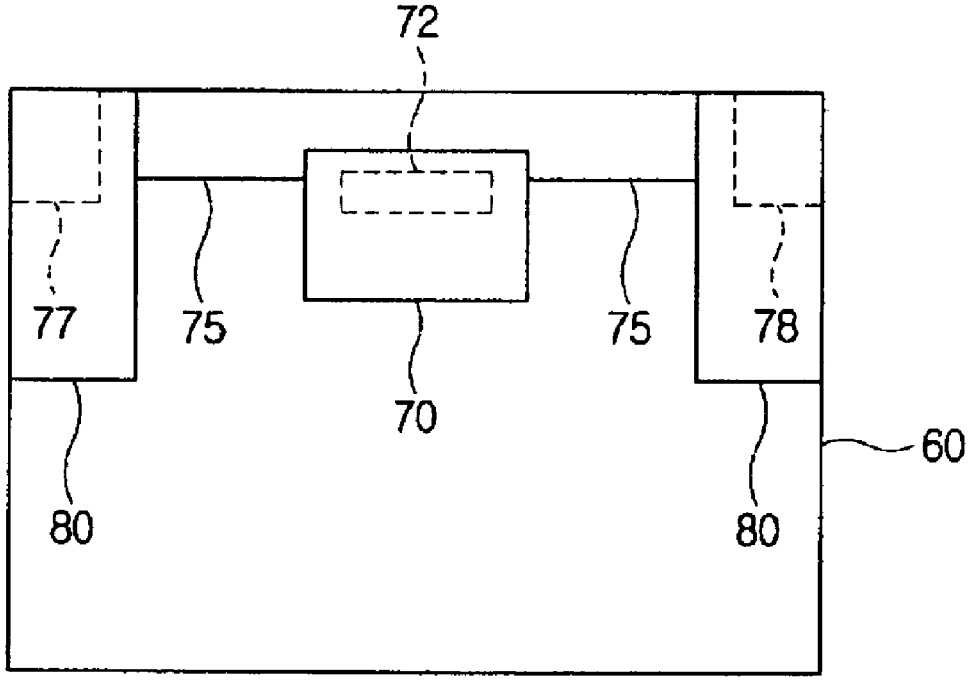
FIG. 3 is a layout view of a back casing of a display apparatus according to a second embodiment of the present invention.

According to a second embodiment of the present invention, as shown in FIG. 3, a transformer consists of a first transformer 77 and second transformer 78, which are adjacent to the lamp electrode parts 42 provide in the opposite ends of the lamp unit 40, respectively. Here, the first and second transformers 77 and 78 according to the second embodiment can be placed corresponding to the respective lamp electrode parts 42 like those of the first embodiment.

In the second embodiment, the inverter 72 is provided as a single unit and outputs the electric power to both the transformers 77 and 78. Alternatively, the inverter 72 can be provided as two units to output the electric power to the first and second transformers 77 and 78, respectively.

Figure 4:
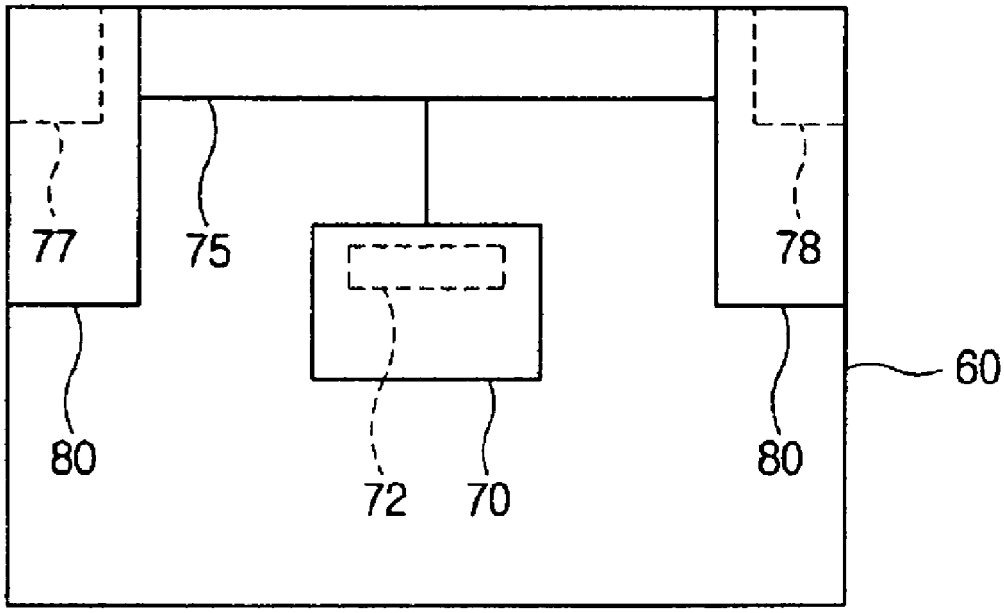
FIG. 4 is a layout view of a back casing of a display apparatus according to a third embodiment of the present invention.

According to a third embodiment of the present invention, as shown in FIG. 4, a transformer consists of a first transformer 77 and a second transformer 78, which are adjacent to the lamp electrode parts 42, respectively. Here, the first and second transformers 77 and 78 according to the third embodiment can be placed corresponding to the respective lamp electrode parts 42 like those of the first and second embodiments. Also, the electric power output from the inverter 72 is branched and supplied to the first and second transformers 77 and 78 placed corresponding to the respective lamp electrode parts 42.

In a case that the lamp unit 40 includes a plurality of lamps and the lamps are driven in parallel, a balance unit 80 is provided for adjusting a current of the electric power applied to each lamp (refer to FIG. 3). Moreover, the transformer 77 can be provided inside the balance unit 80. Alternatively, the transformer 77 may be provided outside the balance unit 80 as long as it is adjacent to the lamp electrode part 42. Here, the balance unit 80 is shown in FIGS. 3 and 4, but not limited to the configuration of FIGS. 3 and 4. Alternatively, the balance unit 80 can be provided in other configurations as long as the lamps are driven in parallel.

In the case that the display apparatus according to an embodiment of the present invention includes the first and second transformers 77 and 78 as described above, the second transformer 78 can be connected to the first transformer 77 in parallel between the inverter 72 and the lamp unit 40 (refer to FIG. 4), or receive the electric power from a separate inverter separately from the inverter 72 for supplying the electric power to the first transformer 77. Further, the current supplied to the lamp unit 40 via the second transformer 78 has a phase difference of 180 degrees from the current output from the first transformer 77. Thus, a differential driving method is applied so that the currents are output from the first and second transformers 77 and 78 in opposite phases. Thus, the amount of current is increased and supplied to the lamp unit 40. Here, the differential driving method is suitable for supplying much current to the lamp shaped like an elongated tube.

Figure 5:
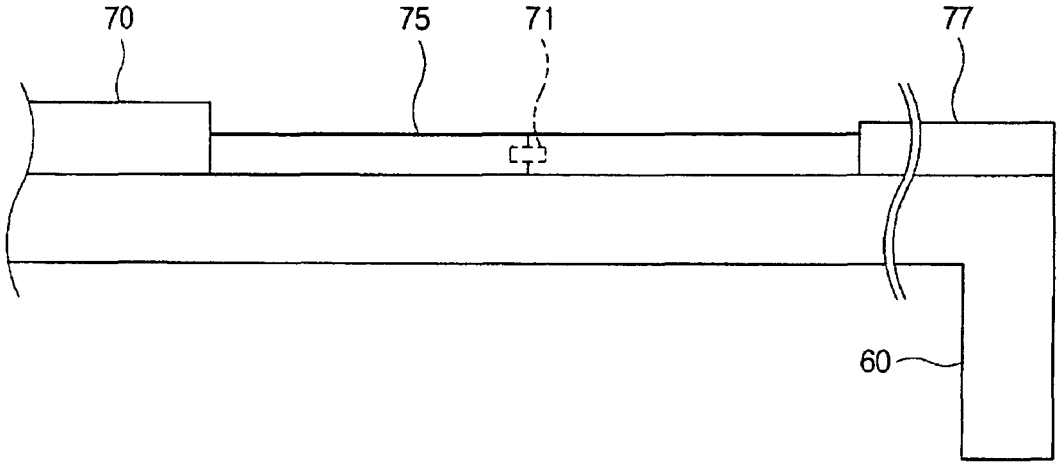
FIG. 5 is a partial sectional view of the back casing of the display apparatus according to an embodiment of the present invention.

In the display apparatus according to an embodiment of the present invention, the electric wire 75, through which the electric power is supplied from the inverter 72, is connected adjacent to the rear casing 60. At this time, the capacitor is formed between the electric wire 75 and the rear casing 60. Hereinafter, the foregoing capacitor will be called a virtual capacitor 71 (refer to FIG. 5). In FIG. 5, one virtual capacitor is illustrated, but not limited thereto. Alternatively, a plurality of virtual capacitors may be provided.

The conventional display apparatus has the long electric wire for supplying the high voltage. Thus, current leaks due to the virtual capacitor 71. The higher the voltage applied to the virtual capacitor 71, the larger the capacitance C of the virtual capacitor 71. Therefore, the current leakage in the virtual capacitor 71 increases as the capacitance C of the virtual capacitor 71 gets larger. Additionally, power loss increases.

On the other hand, in the display apparatus according to an embodiment of the present invention, the electric wire 79 for supplying the high voltage is very close to the lamp electrode part 42, so that the length of the electric wire 79 is relatively short. Therefore, current leakage can be minimized. Further, the electric wire 75 for supplying the low voltage is relatively long, but current scarcely leaks in the electric wire 75 because the capacitance C of the virtual capacitor 71 is very small.

Particularly, the power loss in the virtual capacitor 71 can be obtained by the following equation: $W=\frac{1}{2}\times C\times V^2$. The display apparatus according to an embodiment of the present invention has very small "C" and "V" as compared with the conventional display apparatus. Thus, power loss also decreases.

As described above, in the display apparatus according to an embodiment of the present invention, the electric wire 79 for supplying the high voltage is shortened, thereby decreasing current leakage. Therefore, the electric power output from the inverter 72 is not lost while being supplied to the lamp unit 40. Thus, the efficiency of the inverter 72 increases.

As described above, the embodiments of the present invention provides a display apparatus, in which a high voltage generating position for a lamp unit changes to reduce the length of an electric wire through which a high voltage is supplied.

Further, the embodiments of the present invention provides a display apparatus, in which an electric wire for supplying a high voltage is shortened to reduce the amount of current leakage, thereby enhancing the efficiency of supplying electric power to a lamp unit.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A display apparatus with a panel to display a picture thereon, comprising:

an inverter to convert DC power into AC power;

at least one lamp unit comprising a lamp body and a lamp electrode part provided in at least one of opposite ends of the lamp body to receive an electric power; a transformer arranged adjacent to the lamp electrode part which boosts up a voltage of the electric power output from the inverter to supply the electric power with the boosted voltage as a driving power to the lamp unit; and a casing to accommodate the lamp unit in a position opposite to the panel, wherein the transformer is arranged on an external surface of the casing and positioned directly opposite to the lamp electrode part of at least one lamp unit so that a length of wire between the transformer and the at least one lamp unit is minimized, wherein the transformer comprises a first transformer and a second transformer, and the first transformer is connected to the second transformer in parallel to boost up the voltage output from the inverter, and to supply an electric power having a current which has a phase difference of 180 degrees from the current of the electric power supplied from the second transformer to the lamp unit.

2. The display apparatus according to claim 1, further comprising a balance unit to adjust a current of the electric power applied to each lamp unit, wherein the inverter is provided in the balance unit.

3. The display apparatus according to claim 1, wherein the inverter comprises a first inverter to supply the AC power to the first transformer, and a second inverter to supply the AC power to the second transformer.

4. The display apparatus according to claim 1, further comprising a power supply comprising the inverter.

5. The display apparatus according to claim 1, wherein the lamp comprises at least one of a CCFL, an EEFL and an FFL.

6. A display apparatus, comprising:

a panel to display a picture thereon;

an inverter to convert DC power into AC power;

at least one lamp unit comprising a lamp body and a lamp electrode part provided in at least one of opposite ends of the lamp body to receive an electric power;

a transformer arranged adjacent to the lamp electrode part which boosts up a voltage of the electric power output from the inverter to supply the electric power with the boosted voltage as a driving power to the lamp unit;

a casing to accommodate the lamp unit in a position opposite to the panel; and a balance unit to adjust a current of the electric power applied to each lamp unit, wherein the transformer is arranged on an external surface of the casing and is positioned directly opposite to the lamp electrode part of the at least one lamp unit so that a length of wire between the transformer and the at least one lamp unit is minimized, wherein the transformer comprises a first transformer and a second transformer, and the first transformer is connected to the second transformer in parallel to boost up the voltage output from the inverter, and to supply an electric power having a current which has a phase difference of 180 degrees from the current of the electric power supplied from the second transformer to the lamp unit.

7. The display apparatus according to claim 6, wherein the inverter is provided in the balance unit.

8. The display apparatus according to claim 6, wherein the inverter comprises a first inverter to supply the AC power to the first transformer, and a second inverter to supply the AC power to the second transformer.

9. The display apparatus according to claim 6, further comprising a power supply comprising the inverter.

10. The display apparatus according to claim 6, wherein the lamp comprises at least one of a CCFL, an EEFL and an FFL.

11. An apparatus comprising:

an inverter to convert DC power into AC power; at least one lamp unit comprising a lamp body and a lamp electrode part provided in at least one of opposite ends of the lamp body to receive electric power;

a transformer arranged adjacent to the lamp electrode part which boosts up a voltage of the electric power output from the inverter to supply the electric power with the boosted voltage as a driving power to the lamp unit; and a casing to accommodate the lamp unit, wherein the transformer is arranged on an external surface of the casing and is positioned directly opposite the lamp electrode part of the at least one lamp unit so that a length of wire between the transformer and the lamp unit is minimized, wherein the transformer comprises a first transformer and a second transformer, and the first transformer is connected to the second transformer in parallel to boost up the voltage output from the inverter, and to supply an electric power having a current which has a phase difference of 180 degrees from the current of the electric power supplied from the second transformer to the lamp unit.

12. The power supplying apparatus according to claim 11, further comprising a power supply comprising the inverter.

* * * * *